US008651937B1

(12) United States Patent
Rinaldis

(10) Patent No.: US 8,651,937 B1
(45) Date of Patent: Feb. 18, 2014

(54) APPARATUS AND METHOD FOR AN ELECTRONIC BINGO GAME VARIATION

(76) Inventor: Marcelo Rinaldis, Tulsa, OK (US)

( * ) Notice: Subject to any disclaimer, the term of this patent is extended or adjusted under 35 U.S.C. 154(b) by 305 days.

(21) Appl. No.: 12/979,553

(22) Filed: Dec. 28, 2010

Related U.S. Application Data

(60) Provisional application No. 61/291,222, filed on Dec. 30, 2009.

(51) Int. Cl.
*A63F 9/24* (2006.01)

(52) U.S. Cl.
USPC ..... 463/19; 463/1; 463/16; 463/20; 273/269; 273/138.1; 273/139

(58) Field of Classification Search
USPC ..... 463/16, 19, 20, 1; 273/292, 138.1, 139, 273/269
See application file for complete search history.

(56) References Cited

U.S. PATENT DOCUMENTS

| | | | | |
|---|---|---|---|---|
| 4,312,511 | A | 1/1982 | Jullien | |
| 5,043,887 | A | 8/1991 | Richardson | |
| 5,242,163 | A | 9/1993 | Fulton | |
| 5,569,083 | A | 10/1996 | Fioretti | |
| 5,830,069 | A | 11/1998 | Soltesz et al. | |
| 6,280,325 | B1 | 8/2001 | Fisk | |
| 6,306,038 | B1 | 10/2001 | Graves et al. | |
| 6,599,188 | B2 | 7/2003 | Hirsch et al. | |
| 6,755,739 | B2 | 6/2004 | Santini, Jr. | |
| 6,780,108 | B1 | 8/2004 | Luciano, Jr. et al. | |
| 6,802,776 | B2 | 10/2004 | Lind et al. | |
| 7,717,785 | B2 * | 5/2010 | Odom | 463/19 |
| 2003/0162594 | A1 | 8/2003 | Rowe | |
| 2004/0176169 | A1 | 9/2004 | Lind et al. | |
| 2005/0101387 | A1 | 5/2005 | Wolf | |
| 2005/0164773 | A1 * | 7/2005 | Lind et al. | 463/19 |
| 2005/0208991 | A1 | 9/2005 | Luciano, Jr. et al. | |
| 2006/0035700 | A1 * | 2/2006 | Van Asdale | 463/19 |
| 2006/0052160 | A1 | 3/2006 | Saffari et al. | |
| 2006/0121977 | A1 * | 6/2006 | Odom | 463/19 |
| 2006/0205468 | A1 | 9/2006 | Saffari et al. | |
| 2006/0211483 | A1 * | 9/2006 | Padgett | 463/19 |
| 2007/0093286 | A1 | 4/2007 | Marshall | |
| 2009/0036194 | A1 | 2/2009 | Naicker et al. | |
| 2009/0075715 | A1 | 3/2009 | Coleman et al. | |
| 2010/0041459 | A1 * | 2/2010 | Saffari et al. | 463/19 |

* cited by examiner

*Primary Examiner* — David L Lewis
*Assistant Examiner* — Chase Leichliter
(74) *Attorney, Agent, or Firm* — Frederic Dorwart, Lawyers; Penina Michlin Chiu

(57) ABSTRACT

An apparatus, system and method for an electronic bingo game variation comprising generating at least one electronic bingo card comprising characters from a predetermined character set; drawing a fixed or minimum number of characters to create a draw pool; matching the draw pool to the bingo card; daubing the matches to create a pattern; comparing the pattern to a set of qualifying patterns to identifying a qualifying bingo card. A qualifying pattern may comprise a pattern one match short of a winning pattern. At the conclusion of the game, offering a second chance to win to players with qualifying cards, the second chance comprising repopulating each square of the qualifying card, exclusive of the qualifying pattern, with new characters to create a second card and reapplying the draw pool to identify a second chance winner.

20 Claims, 10 Drawing Sheets

Prior Art

Prior Art

601

603

605

606

607

609

APPARATUS AND METHOD FOR AN ELECTRONIC BINGO GAME VARIATION

CROSS REFERENCE TO RELATED APPLICATIONS

This Application claims the benefit of U.S. Provisional Application No. 61/291,222 to Rinaldis, filed Dec. 30, 2009 and entitled, "APPARATUS AND METHOD FOR AN ELECTRONIC BINGO GAME VARIATION," which is hereby incorporated by reference in its entirety.

BACKGROUND OF THE INVENTION

1. Field of the Invention

Embodiments of the invention described herein pertain to the field of computer systems. More particularly, but not by way of limitation, one or more embodiments of the invention enable an apparatus, system and method for an electronic bingo game variation.

2. Description of the Related Art

The origin of the game of bingo has been traced to a lottery game played in Italy around 1530 A.D. This game was played by matching numbers on a card containing three horizontal rows and nine vertical rows. The modern game of bingo was reportedly invented by Edwin Lowe, who discovered a variation of the Italian game being played in the American south in the late 1920's. Lowe brought the game to New York, developing his own unique cards and rules, and is credited with naming the game "bingo." His version became widely popular and is still played today in church basements, recreation centers and casinos across the country and around the world. Unfortunately for Mr. Lowe, he was unable to patent his game, though many variations of the standard game have since been patented.

The standard game of bingo is generally played as illustrated in FIG. 1. First, a player buys one or more bingo cards with which to play the game at step 101. The card cost may be used to create a jackpot split between the winner or winners and the house. FIG. 2 illustrates an example of a standard bingo card 201. At step 103 the player receives a card containing a matrix of characters 203, arranged in any of a number of formats of rows and columns. In the standard game, matrix of characters 203 comprises 25 squares arranged in five columns by five rows, each row headed by one of the letters of the word "bingo." Matrix of characters 203 is populated from a predetermined set of available characters, such as the numbers between 1 and 75, inclusive. In FIG. 2, for example, the character "74" is indicated by reference 205. In many variations, the central square 207 is a free space, meaning it is considered filled. In the standard game, the "B" column may contain numbers from 1 to 15, the "I" column may contain numbers from 16 to 30, the "N" column may contain numbers from 31 to 45, the "G" column may contain numbers from 46 to 60, and the "O" column may contain numbers from 61 to 75. The variation of the standard game represented by card 201 reportedly has $5.52*10^{26}$ possible arrangements of numbers on a bingo card.

Play begins at step 105 when a "caller" selects a bingo ball from a pool of available bingo balls. A bingo ball may resemble a ping pong ball marked with one assigned character selected from the numbers 1 to 75. The caller calls out the character on the drawn bingo ball and the players attempt to match the draw to the characters on the player's bingo card 201. For example, bingo ball "74" would match character 205 of bingo card 201. If the drawn character matches a character on the card, the character on card is "daubed" at step 107, meaning it is marked with an indicator of a match. In FIG. 2, circle 213 is a "daub" placed on the second square under the column headed "I" to indicate a match. The drawn character then joins the pool of drawn characters at step 109.

At step 111 the daubs on bingo card 201 are checked to see if the daubs create a pattern that matches any of a predetermined set of winning patterns. For example, daubing all the characters in the first row of matrix 203 creates a "line" of daubs. A line may be a winning pattern in one or more games. The various patterns in the set of winning patterns may have different payout amounts or payout percentages.

Traditionally, when a player achieves a winning pattern the player yells, "bingo!" and the card is independently verified against the draw pool as a winner, as shown at step 113. In the standard game, when a player achieves "bingo!" the player receives the jackpot and the game ends at step 115. If multiple players achieve "bingo!" at the same time, the jackpot is shared among them.

If no one wins, at step 117, the number of draws is checked to see if a maximum number of balls have been drawn (typically 39 balls). If not, the game continues back at step 105 with a new draw. If the maximum bingo balls have been drawn without a winner, the game ends at step 115 and the jackpot rolls over (or accrues to the house) and a new game may begin.

Recently, electronic games have been developed offering variations on the standard bingo game, such as giving the player an opportunity for one or more extra bingo balls if the player has a losing card that meets various criteria for being close to a winning pattern. For example, see U.S. Patent application 2009/0075715 by Coleman. Other recent patents provide the player the chance to change or modify a losing card if there is no winner, such as the game of Graves described in U.S. Pat. No. 6,306,038. However, there is a continuing commercial need for new and exciting electronic bingo games that provide second chance games that will encourage players to continue to patronize bingo providers. For at least the limitations described above there is a need for an apparatus and method for new forms of second chance electronic bingo games.

BRIEF SUMMARY OF THE INVENTION

One or more embodiments of the invention enable an apparatus, system and method for an electronic bingo game variation.

An apparatus, system and method for an electronic bingo game variation is described, the apparatus, system and method comprising generating an electronic bingo card for an electronic bingo game, the bingo card comprising a predetermined set of available characters. The user may or may not be charged to play the game. In some embodiments, the user may select the characters for the card; in other embodiments the system will assign the characters to the matrix of the electronic bingo card. In some embodiments the game is a multiplayer game, such as in a bingo hall embodiment, certain casino embodiments or a charitable bingo embodiment, in other embodiments the player may play against the house, such as in certain casino embodiments. Play proceeds when the system draws one or more bingo balls; comparing the bingo ball's character to each character of the bingo card to determine a match. Matches are electronically "daubed" on the card to create a pattern on the one or more electronic bingo cards. The system of the invention may then compare the pattern of daubs to a set of qualifying patterns to identifying a qualifying bingo card. A qualifying pattern may comprise a pattern that is one match short of a winning pattern. At the conclusion of the primary game, the system may offer a second chance to win to players with at least one qualifying card, the second chance comprising repopulating each square of the qualifying card, exclusive of the qualifying pattern and/or exclusive of daubed matches, each with a new character to create a second electronic bingo card; and applying the draw pool to the second card to identify a second chance winner.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein.

Figure 1:
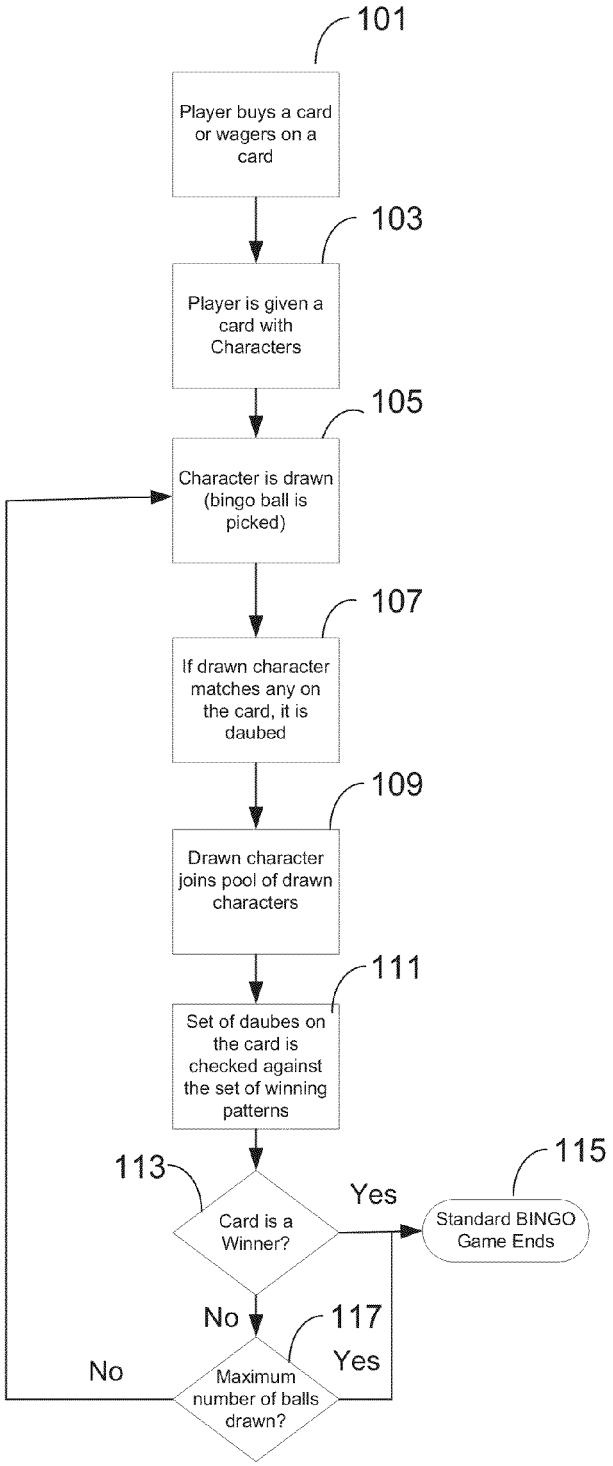
FIG. 1 is a flowchart illustrating the method of playing one or more variations of the standard game of bingo of the prior art.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

An apparatus and method for an electronic bingo game variation will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

One or more embodiments of the invention provide new variations of an electronic bingo game. The game of the invention may be played on plurality of computer apparatuses such as, for example, a casino slot-machine-style device, a personal computer (through an installed application or a web browser) such as a desktop, laptop, a netbook computer, palm computer, PDA or other personal computing device, a gaming console computer, a handheld computing device, a cellular telephone or any computing system capable of performing the instructions required to play the game, such as a system illustrated in FIG. 10 and described below. Computer apparatuses capable of performing the game may provide a display to show the player one or more electronic bingo cards and provide controls (physical controls, such as buttons or keys, or virtual or programmed controls, such as buttons on a touch screen) for the various input and output functions needed to play the game. While the invention is described in terms of a casino-style embodiment, nothing herein is intended to limit the invention to that embodiment.

Figure 3:
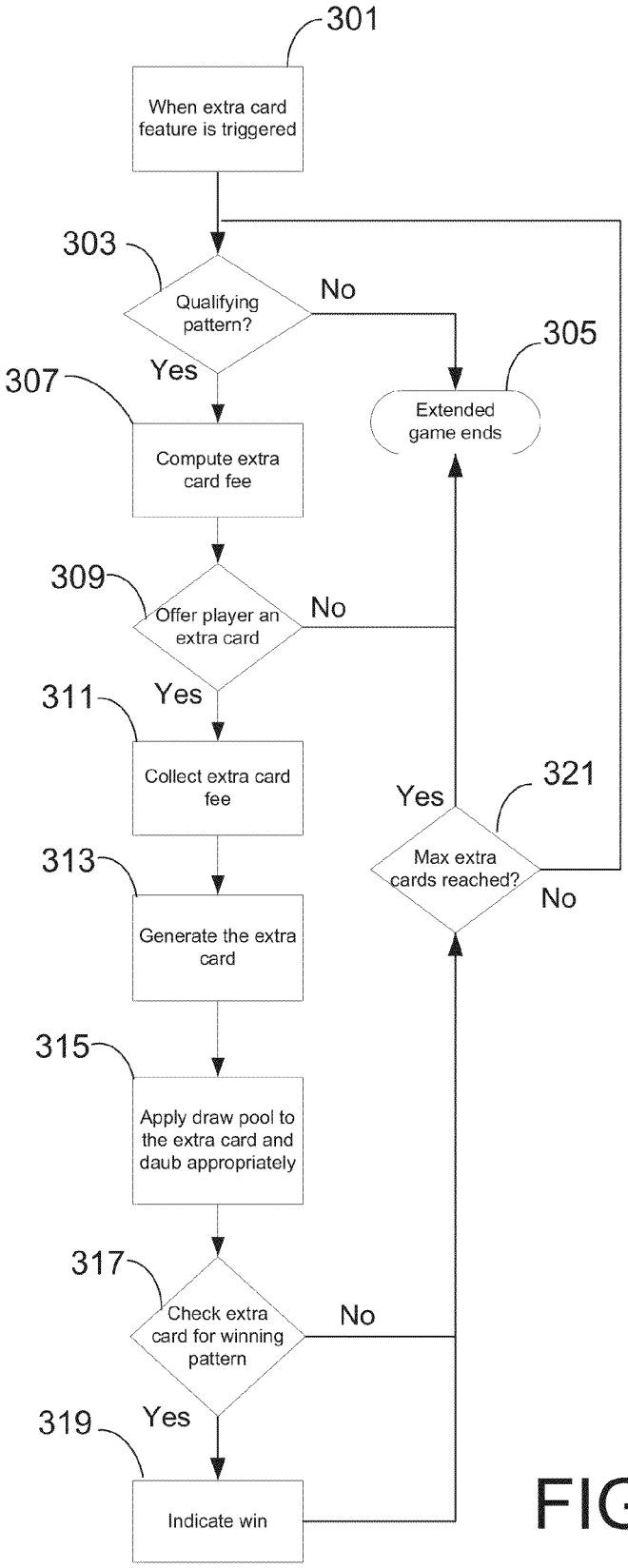
FIG. 3 is a flow chart illustrating the second chance options of the game in one or more embodiments of the invention.

The electronic bingo game of the invention may be played as a multi-player game, where a group of players contribute to and share in a jackpot pool. In some multi-player embodiments, such as a bingo hall, all players at a given location may participate in the jackpot pool. In other embodiments players may participate in a jackpot pool of players connected by a network, over the Internet, or other form of communication link as understood by those of skill in the art. For example, a 93% return to the winner(s) may be used, where for example where the house collects $1000.00, on average $930.00 goes to the winner(s). In still other embodiments, a player may play alone against the "house," such as in an embodiment installed on a personal computer or an embodiment at a casino. While the invention is described in terms of a single-player game for clarity of description and to better illustrate the novelty of the invention, the invention applies equally to multiplayer embodiments. FIG. 3 illustrates one method of the game of the invention. A detailed description of FIG. 3 may be found below.

Figure 2:
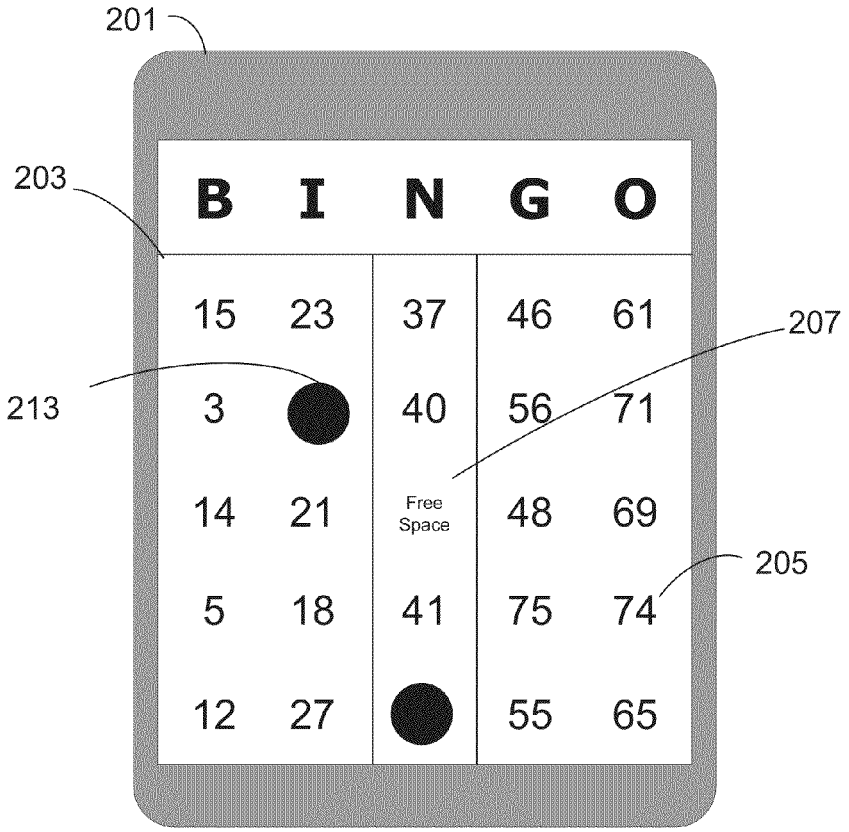
FIG. 2 illustrates an exemplary bingo card for a standard bingo game of the prior art.

The electronic bingo card of the invention may comprise any form of matrix of squares displayed by a computer to a player/user. Any format of card is contemplated by the invention, from the traditional five by five matrix of the card in FIG. 2 to the more modern electronic bingo card of three rows by five columns of card of FIG. 4. Thus, the invention is not limited to any particularly sized matrix of characters. So as to clearly explain the invention, this description focuses on the format of electronic bingo card 401 as illustrated in FIG. 4.

Figure 4:
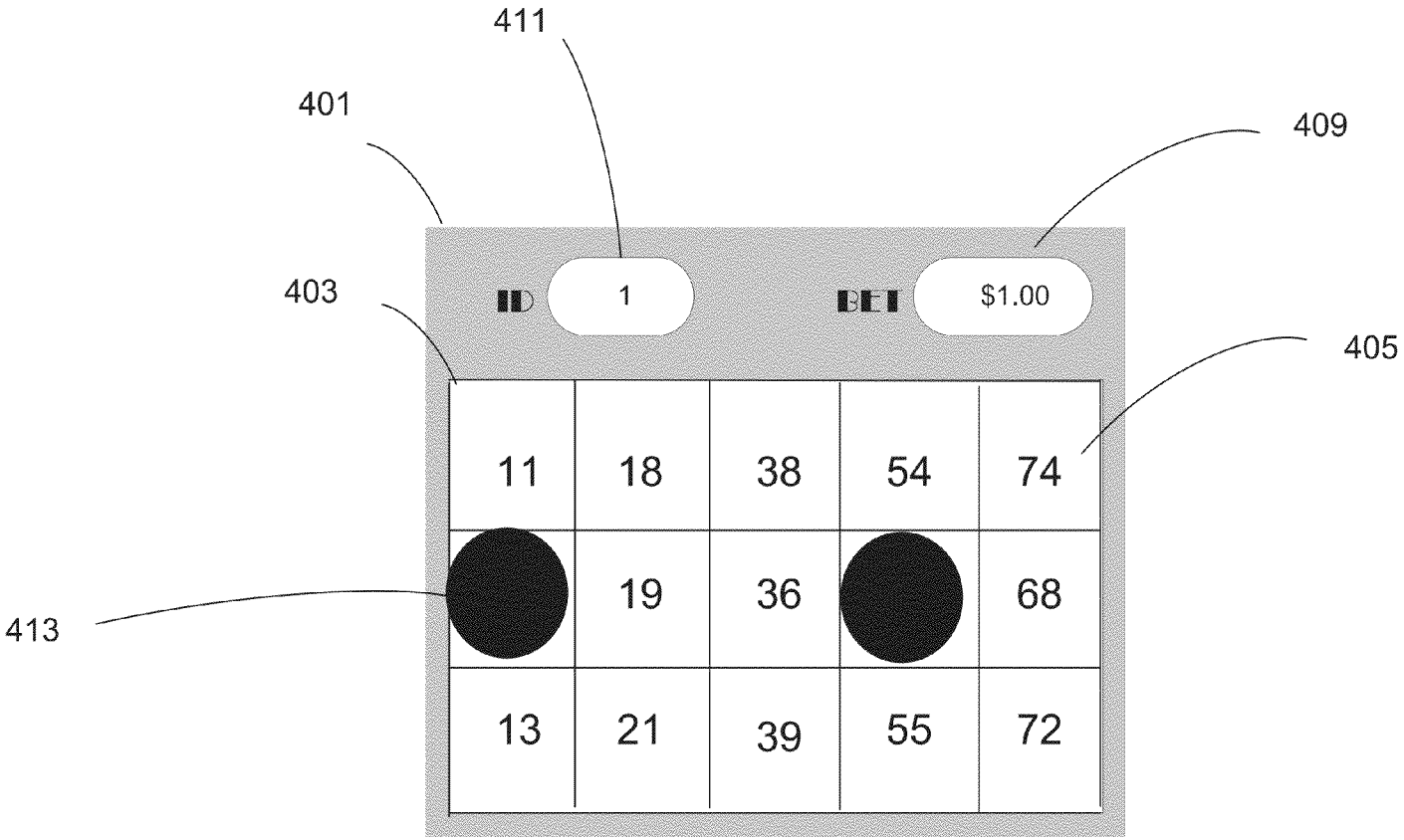
FIG. 4 illustrates an electronic bingo card that may be used in one or more embodiments of the invention.
Figure 5A:
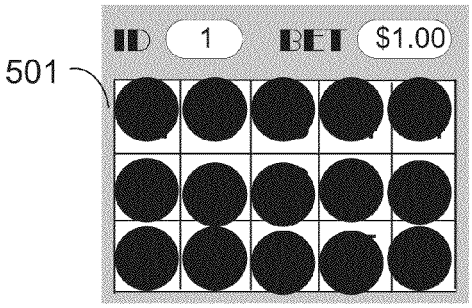
FIG. 5A-5F illustrates a predetermined set of winning patterns in one or more embodiments of the invention.
Figure 5B:
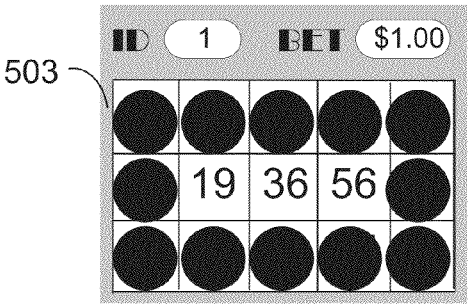
Figure 5C:
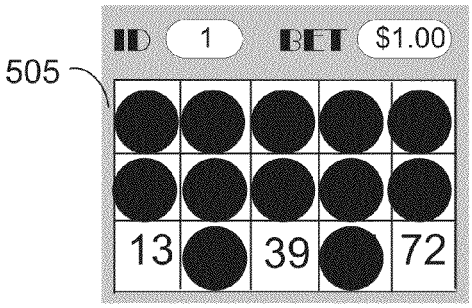
Figure 5D:
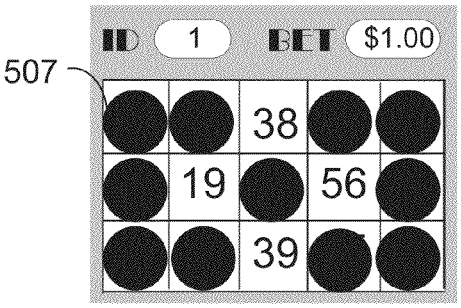
Figure 5E:
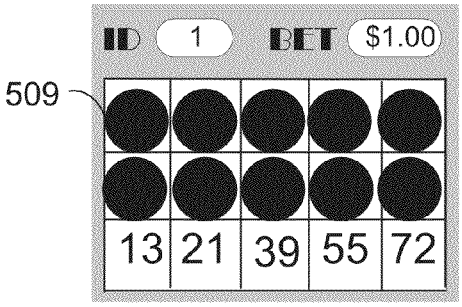
Figure 5F:
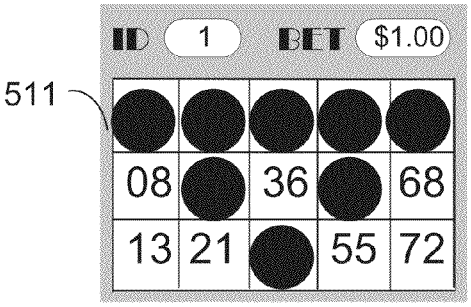
Figure 6A:
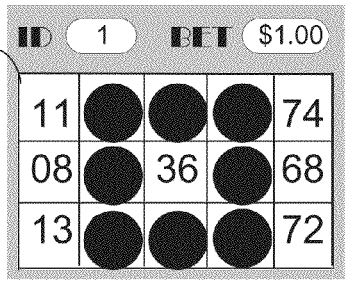
FIG. 6A-6F illustrates an additional predetermined set of winning patterns in one or more embodiments of the invention.
Figure 6B:
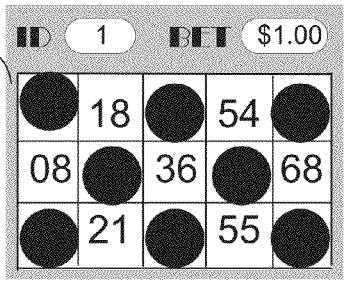
Figure 6C:
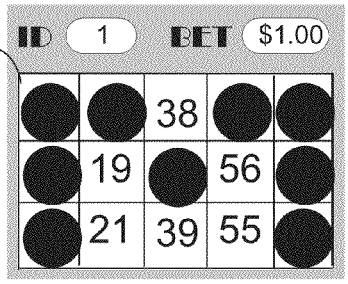
Figure 6D:
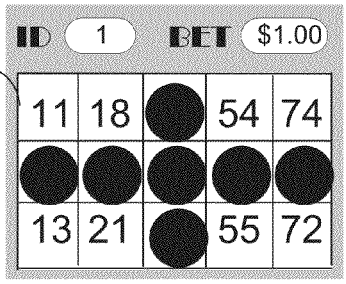
Figure 6E:
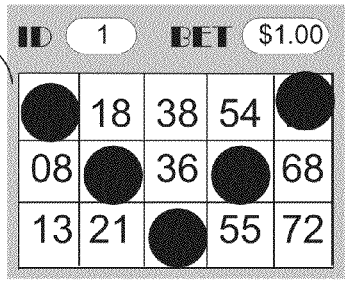
Figure 6F:
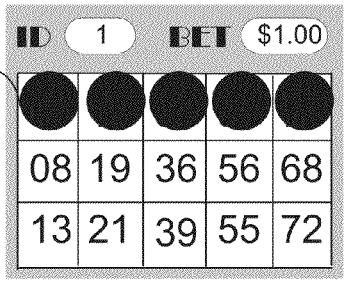

The electronic bingo card of FIG. 4 comprises a matrix of characters 403 chosen from a predetermined set of available characters. In some embodiments, the characters on electronic bingo card 401 may be selected randomly, selected using a pseudo-random generation algorithm well known to those of skill in the art or selected by a player. While the predetermined set of available characters typically comprises the numbers 1 to 75, as in the standard game described above, the invention is not so limited and will perform equally as well with a character set of, for example, symbols, icons, words, pictographs, cartoons, photographs or other representations that may be matched during the draw. For example, the character "74" appears in matrix of characters 403 and is indicated by reference 405. So as not to obscure the novelty of the invention, the method of the invention is described in terms of the standard character set of 1 to 75, but it is not so limited. Exemplary electronic bingo card 401 may also include an identifier such as ID 411 for multi-card embodiments, and may display the amount bet on card 401, as shown in bet window 409 or may display the purchase price of card 401. In various embodiments, players may play multiple cards in a single game. In a casino-style or bingo hall embodiment, for example, a player may select up to four cards in a primary game, or any number of cards supported by the display device of the computational unit providing access to the game.

The system of the invention may indicate a daub on electronic bingo card 401 using any of a plurality of methods known to those of skill in the art. For example, spot 413 may be used in one or more embodiments. Alternatively, "X" 805 may be used to daub a square.

In the standard game of bingo, the bingo balls may be ping pong balls or similar balls, for example. The pool of available characters would include exactly 75 balls each marked with a unique number from 1 to 75. The balls may be placed in a rotating basket that is turned after each draw to mix up, and thereby randomize, the numbers. A "caller" would select a ball, read the number on the ball, place the ball on a display rack (the "draw pool" or "drawing pool") and turn the basket to again mix up the numbers before drawing the next ball. In one or more embodiments, such as those where the character set is 1 to 75, the draw pool will be complete when 39 of 75 balls have been drawn, for example. In other embodiments, the drawing will continue until there is a winner or all 75 balls have been drawn.

Figure 7:
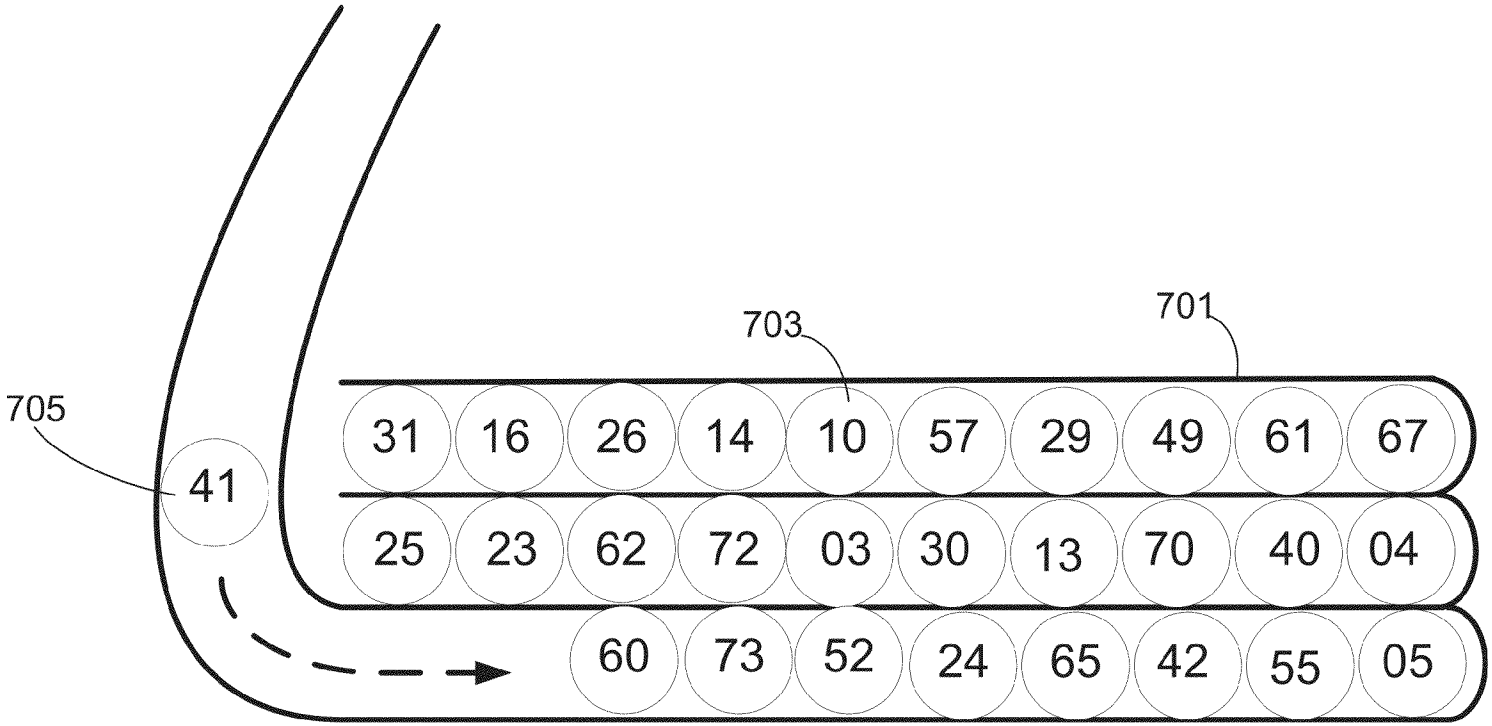
FIG. 7 illustrates an exemplary graphical user interface representation of a draw pool for one or more embodiments of the invention.

A "bingo ball" in the spirit of the invention means an electronic representation of a bingo ball bearing a character selected from a pool of available characters in the predetermined set of characters. In some embodiments the electronic bingo ball will be a graphical user interface element drawn to look like a standard bingo ball. For example, FIG. 7 illustrates a draw pool in one or more embodiments of the invention that may be displayed on the apparatus of the invention to indicate to the player which characters have been drawn. Draw pool rack 701 provides a screen element for displaying a plurality of "bingo balls" 703. In one or more embodiments, a plurality of bingo ball characters is randomly drawn from the pool of available characters, for example 703. The drawn bingo balls may be displayed as "rolling down" draw pool rack 701 to rest in the next open slot, as shown by bingo ball icon 705. In other embodiments, the drawn bingo ball may flash on the player's screen. The draw pool of FIG. 7 will be used elsewhere herein for illustration purposes only. Any representation of the draw pool to the player is within the scope of the invention.

In the primary game, characters for matching to the cards are selected by randomly drawing characters from a pool of characters comprising one each of all the characters available in the game. The drawing may be completed by using a pseudo-random generation or a truly random generation procedure. For example, in a game where the characters are the numbers 1 to 75 the pool of available characters would be 75 bingo balls, each bearing one assigned character from 1 to 75. In other embodiments, the pool of available characters might comprise roulette numbers or other character sets known to those of skill in the art. In certain embodiments, the characters for matching to the cards may be selected from a list or predetermined based upon a non-random generation algorithm.

In the electronic bingo game of the invention, the "bingo balls" may be represented graphically on a display to resemble bingo balls, or may be numbers displayed in any format known to those of skill in the art. The number of bingo balls drawn depends on the variation of the bingo game being played. In one or more embodiments, 39 bingo balls are "drawn" by using any random number or pseudo-random number generation method that will select from a fixed set of value, such as those methods known to those of skill in the programming arts. For example, in one or more embodiments a Mersenne Twister algorithm may be used. A Mersenne Twister algorithm is a pseudo-random-number generator that is based on a matrix linear recurrence over a finite binary field. In some embodiments, the entire draw pool will appear when a player presses the "play" button, producing an instant result to the primary game for example as in a "Bonanza" bingo game.

Various modern bingo games comprise a number of winning patterns of daubs. Different patterns have a different statistical likelihood of occurring and the payout for matching a given pattern reflects that likelihood. FIGS. 5A to 5F and 6A to 6F illustrate various winning patterns provided by one or more embodiments of the invention. A single embodiment may not support all of the winning patterns illustrated but will still be within the scope of the invention. Other embodiments, including those with other electronic bingo card formats, may use other patterns as winning patterns. FIGS. 5A to 5F and 6A to 6F are provided for illustration only.

| FIG. | Pattern Reference | Winning Patterns | Example Payout (for a $1.00 bet) |
|---|---|---|---|
| 5A | 501 | BINGO | $15,000.00 |
| 5B | 503 | Perimeter | $7,500.00 |
| 5C | 505 | Double Pyramid | $5,000.00 |
| 5D | 507 | Letters "M", "W" | $2,000.00 |
| 5E | 509 | Two lines | $1000 |
| 5F | 511 | Bonus | Bonus card |
| 6A | 601 | Square | $250.00 |
| 6B | 603 | Chess | $200.00 |
| 6C | 605 | Letter "M" | $150.00 |
| 6D | 606 | Plus (+) | $80.00 |
| 6E | 607 | Letter "V" | $10.00 |
| 6F | 609 | One Line | $10.00 |

Figure 8B:
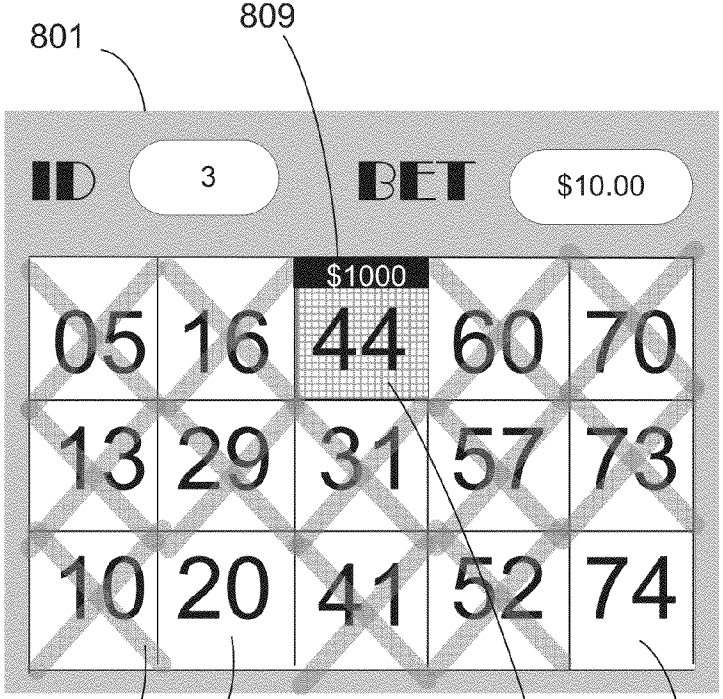
FIG. 8B illustrate the electronic bingo card of FIG. 8A showing a qualifying pattern in one or more embodiments of the invention.
Figure 8A:
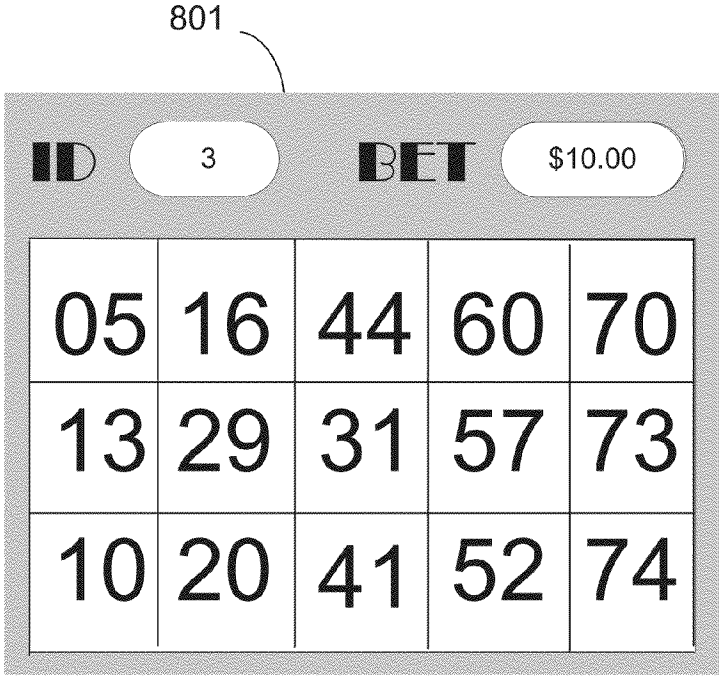
FIG. 8A illustrates an electronic bingo card of one or more embodiments of the invention.

Play in the game of the invention may proceed in any number of variations of the game, such as that described by FIG. 3 and elsewhere herein, for example. The player may begin with one or more electronic bingo cards such as card 801 of FIG. 8A. Card 801 is self-identified as card number 3 for the player. The player has wagered $10.00 on card 801. After one, a few, or all of the bingo balls are drawn in the primary game the matching squares are electronically daubed, as illustrated in FIG. 8B and the pattern of daubs is compared to the winning patterns, for example the patterns described above. Where more than one winning pattern is matched, the player may be awarded the highest prize or the player may be awarded multiple prizes.

In the system of the invention, at the conclusion of the primary game, the extra card feature of the invention may be triggered at step 301 whether or not the player's card contains a winning pattern. At step 303, the system evaluates the daub pattern of electronic bingo card 801 to see if it is qualifying pattern. In one or more embodiments, a "qualifying pattern" may be a pattern that is within one daub of matching a winning pattern, where the winning pattern has a payout greater than any payout the player has already earned. In some embodiments the set of qualifying patterns may be derived from less than all the winning patterns. In one or more embodiments, a card with a qualifying pattern is a qualifying electronic bingo card.

As shown in FIG. 8B, the daub pattern on card 801 matches winning patterns 607 ("V") and 609 ("One Line"), both of which pay $10.00 in the example embodiment. The evaluation at step 303 determines that the pattern of card 801 is also a qualifying pattern, in that it is one match short of the following winning patterns:

| FIG. | Pattern Reference | Winning Patterns | Example Payout ($1.00 bet) | Missing Square |
|---|---|---|---|---|
| 5E | 509 | Two lines | $1000.00 | 807 |
| 5F | 511 | Bonus | Bonus card | 807 |
| 6C | 605 | Letter "M" | $150.00 | 811 |
| 6D | 606 | Plus (+) | $80.00 | 807 |

As winning pattern 509 wins the highest payout of the qualifying pattern matched, that payout amount may be indicated to the player on the display, as exemplified by banner 809 shown on square 807. Returning to FIG. 3, if the daub pattern of the card is not a qualifying pattern, then the extended game may end at step 305. In the example of card 801, the daub pattern is a qualifying pattern so the system may compute the extra card fee at step 307.

The extra card fee may be calculated using a variety of methods. In certain embodiments, the extra card fee may be a fixed predetermined value or may vary based upon the amount bet by the player. In some embodiments, the extra card fee may depend on the probability that the extra card will complete a new winning hand and the amount of the payout that can be won for that hand, i.e., the expected value of the extra card. If a hand is one card away from more than one winning hand, then the extra card fee may be cumulative. For instance, in the example of card 801, in some embodiments, the extra card fee may be the expected value of obtaining winning pattern 509 plus the expected value of obtaining winning pattern 511 plus the expected value of obtaining winning pattern 605, plus the expected value of obtaining winning pattern 606. In certain embodiments, the expected value of obtaining a winning pattern may be the payout which may be won for achieving that winning pattern times the probability of that winning pattern occurring. The extra card fee may be rounded to determine the final fee. For example, $0.204 may be rounded up to twenty-one cents, or it may be rounded down to twenty cents. In some embodiments, the rounding may take place during each individual expected value calculation. In other embodiments, the cost may be rounded only after all the expected values have been added together. In yet other embodiments, only one or two decimal places may be retained during calculations and no rounding may be necessary.

The player may be offered a second chance to win with an extra card at step 309. If the player chooses the extra card option, the system collects the second chance fee for the extra card at step 311. A second chance to win may be offered on multiple cards where the player is playing in a multi-card embodiment. A player may be offered the chance to enable or disable some qualifying cards before betting on a second chance to win.

Figure 9:
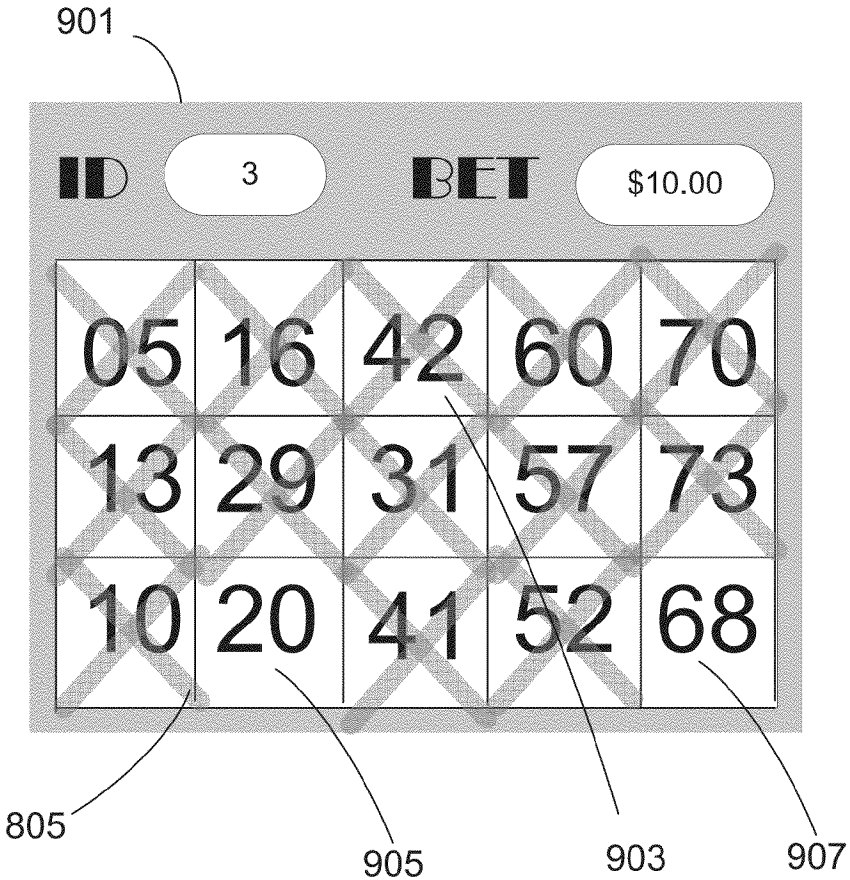
FIG. 9 illustrates a second electronic bingo card of one or more embodiments of the invention.

At step 313, the system generates an extra card, such as second electronic bingo card 901 (an "extra card") of FIG. 9. In one or more embodiments, generating extra card 901 comprises copying the daubed squares of electronic bingo card 801 and then substituting new characters into undaubed squares 809, 811, and 813. All other squares of card 801 retain their characters and daub marks, such as mark 805, in extra card 901. In one or more embodiments, the system randomly selects the replacement characters for the undaubed squares from the remaining set of predetermined available characters to create extra card 901 using techniques known to those of skill in the programming arts. In other embodiments, the system may select the replacement characters for the undaubed squares from a list or the replacement characters may be predetermined from the earlier draw. Extra card 901 illustrates three new characters selected for squares 903 ("42"), 905 ("20"), and 907 ("68").

At step 315, the system applies the draw pool (see FIG. 7) to extra card 901 and daubs the squares containing matches; in this case, square 903 contains character "42." Squares 905 and 907 do not match any characters in the draw pool. At step 317 the system evaluates the daub pattern of extra card 901 to determine the highest winning pattern or an additional winning pattern for the card. In this example, extra card 901 now matches winning pattern 509 for the higher prize of $1000. The win may then be indicated to the player at step 319.

Whether the card wins or not, in one or more embodiments the system may offer the player another chance to play. If selected, the system may generate another second chance card, up to the maximum number of second chance cards allowed, as indicated by step 321. In this example, the system may then return to step 303 to reevaluate extra card 901, which now contains a qualifying pattern for winning pattern 505 (missing only square 905). Winning pattern 505 has a higher payout of $5000, so play may continue at step 307 as described above. In some embodiments, an additional winning pattern may have an equal or lower payout than that already won, if any, to qualify the player for an extra card.

Computer System Architecture

The method described herein is not limited as to the type of computer it may run upon and may for instance operate on any generalized computer system that has the computational ability to execute the methods described herein and can display the results of the user's/player's choices on a display means. The computer typically includes at least a keyboard, a display device such as a monitor, and a pointing device such as a mouse. The computer also typically comprises a random access memory, a read only memory, a central processing unit and a storage device such as a hard disk drive. In some embodiments of the interface, the computer may also comprise a network connection that allows the computer to send and receive data through a computer network such as the Internet. Casino-style electronic gaming machines, bingo hall electronic gaming machines, mobile computer platforms such as cellular telephones, smart phone, Personal Desktop Assistants (PDAs), kiosks, set top boxes, games boxes or any other computational device, portable, personal or otherwise, may also qualify as a computer system capable of executing the methods described herein.

In various embodiments, the present invention may be implemented as a method, apparatus, or article of manufacture using standard "programming and/or engineering techniques to produce software, firmware, hardware, or any combination thereof. The term "article of manufacture" (or alternatively, "computer program product") as used herein is intended to encompass a computer program accessible from any computer-readable device, carrier or media. In addition, the software in which various embodiments are implemented may be accessible through the transmission medium, for example, from a server over the network. The article of manufacture in which the code is implemented also encompasses transmission media, such as the network transmission line and wireless transmission media. Thus, the article of manufacture also comprises the medium in which the code is embedded. Those skilled in the art will recognize that many modifications may be made to this configuration without departing from the scope of the present invention.

Embodiments of the system may display one or more electronic bingo cards, the display of which is embodied in software that may execute on one or more computers having a computer usable tangible memory medium (or a computer-readable memory medium) and computer readable program code. The computer-readable program code may include an input function, display function, computation functions, card reader function and other functions typical of a gaming computer as understood by those of skill in the art. The various software functions are configured to perform the functions of an electronic bingo game variation.

Furthermore, embodiments of the present invention may be implemented as a program of computer-readable instructions ("computer-readable program code") and/or computer-readable data stored on a computer-readable medium. Programs, data and other information may constitute, but are not limited to, sets of computer instructions, code sequences, configuration information, and other information in any form, format or language usable by a general purpose computer or other processing device, such that when such a computer contains, is programmed with, or has access to said programs, data and other information said general purpose computer is transformed into a machine capable of performing an electronic bingo game variation, such as those described above. A computer-readable medium suitable to provide computer readable instructions and/or computer readable data for the methods and processes described herein may be any type of magnetic, optical, or electrical storage medium including a disk, tape, CD, DVD, flash drive, thumb drive, storage card, or any other memory device or other storage medium known to those of skill in the art.

In one or more embodiments of the invention, the methods described here may not be limited as to the type of computer it may run upon and may for instance operate on any generalized computer system that has the computational ability to execute the methods described herein and can display the results of the user's choices on one or more display devices. Display devices appropriate for providing interaction with the invention described herein includes, but is not limited to, computer monitors, cell phones, PDAs, televisions, or any other form of computer controllable output display. As used herein, a computer system refers to but is not limited to any type of computing device, including its associated computer software, data, peripheral devices, communications equipment and any required or desired computers that may achieve direct or indirect communication with a primary computing device.

In one or more embodiments of the invention, a general-purpose computer may be utilized to implement one or more aspects of the invention. In one or more embodiments of the invention, the computer may include various input and output means, including but not limited to a keyboard or other textual input devices, a display device such as a monitor or other display screen, and a pointing device and/or user selection indicator such as a mouse, keypad, touch screen, pointing device, or other known input/output devices known to those of skill in the art. The general-purpose computer described herein may include one or more banks of random access memory, read only memory, and one or more central processing unit(s). The general-purpose computer described herein may also include one or more data storage device(s) such as a hard disk drive, or other computer readable medium discussed above. An operating system that executes within the computer memory may provide an interface between the hardware and software. The operating system may be responsible for managing, coordinating and sharing of the limited resources within the computer. Software programs that run on the computer may be performed by an operating system to provide an electronic bingo game variation of the invention with access to the resources needed to execute. In other embodiments the electronic bingo game may run stand-alone on the processor to perform the methods described herein.

In one or more embodiments of the invention, the method(s) described herein, when loaded on or executing through or by one or more general purpose computer(s) described above, may transform the general-purpose computer(s) into a specially programmed computer able to perform the method or methods described herein. In one or more embodiments of the invention, the computer-readable storage medium(s) encoded with computer program instructions that, when accessed by a computer, may cause the computer to load the electronic bingo game instructions to a memory there accessible, thereby creates a specially programmed computer able to perform the methods described herein as a specially programmed computer.

The specially programmed computer of the invention may also comprise a connection that allows the computer to send and/or receive data through a computer network such as the Internet or other communication network. Mobile computer platforms such as cellular telephones, Personal Desktop Assistants (PDAs), other hand-held computing devices, digital recorders, wearable computing devices, kiosks, set top boxes, games boxes or any other computational device, portable, personal, real or virtual or otherwise, may also qualify as a computer system or part of a computer system capable of executing the methods described herein as a specially programmed computer.

Figure 10:
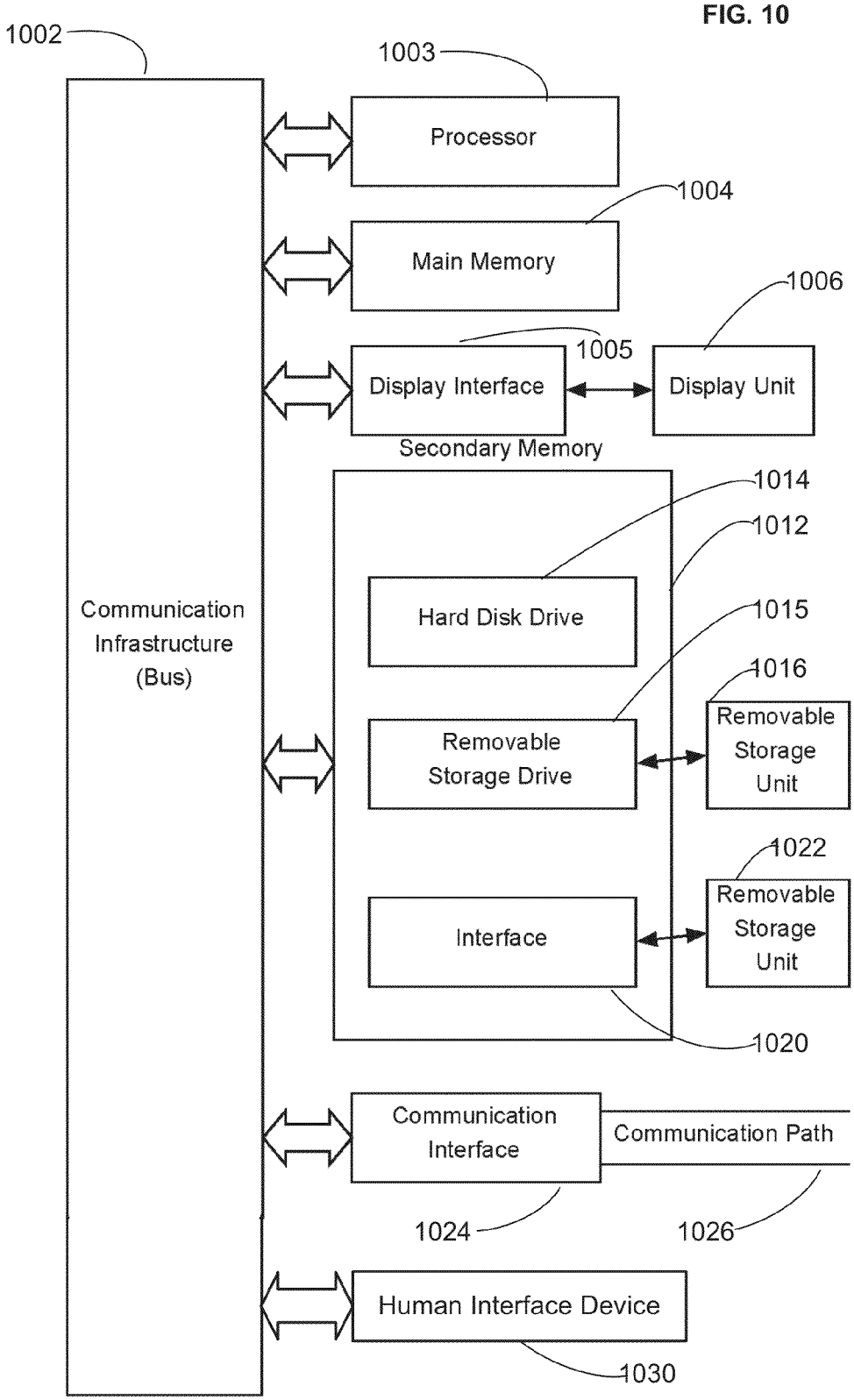
FIG. 10 illustrates a general-purpose computer and peripherals that when programmed as described herein may operate as a programmed computer capable of implementing one or more methods, apparatus and/or systems of the invention.

FIG. 10 depicts a general-purpose computer and peripherals, when programmed as described herein, may operate as a specially programmed computer capable of implementing one or more methods, apparatus and/or systems of the invention. Processor 1003 may be coupled to bi-directional communication infrastructure 1002 such as Communication Infrastructure System Bus 1002. Communication Infrastructure 1002 may generally be a system bus that provides an interface to the other components in the general-purpose computer system such as Processor 1003, Main Memory 1004, Display Interface 1005, Secondary Memory 1012 and/or Communication Interface 1024.

Main memory 1004 may provide a computer readable medium for accessing and executed stored data and applications. Display Interface 1005 may communicate with Display Unit 1006 that may be utilized to display outputs to the user of the specially-programmed computer system. Display Unit 1006 may comprise one or more monitors that may visually depict aspects of the computer program to the user. Main Memory 1004 and Display Interface 1005 may be coupled to Communication Infrastructure 1002, which may serve as the interface point to Secondary Memory 1012 and Communication Interface 1024. Secondary Memory 1012 may provide additional memory resources beyond main Memory 1004, and may generally function as a storage location for computer programs to be executed by Processor 1003. Either fixed or removable computer-readable media may serve as Secondary Memory 1012. Secondary Memory 1012 may comprise, for example, Hard Disk 1014 and Removable Storage Drive 1015 that may have an associated Removable Storage Unit 1016.

There may be multiple sources of Secondary Memory 1012 and systems of the invention may be configured as needed to support the data storage requirements of the user and the methods described herein. Secondary Memory 1012 may also comprise Interface 1020 that serves as an interface point to additional storage such as Removable Storage Unit 1022. Numerous types of data storage devices may serve as repositories for data utilized by the specially programmed computer system of the invention. For example, magnetic, optical or magnetic-optical storage systems, or any other available mass storage technology that provides a repository for digital information may be used.

Communication Interface 1024 may be coupled to Communication Infrastructure 1002 and may serve as a conduit for data destined for or received from Communication Path 1026. A Network Interface Card (NIC) is an example of the type of device that once coupled to Communication Infrastructure 1002 may provide a mechanism for transporting data to Communication Path 1026. Computer networks such Local Area Networks (LAN), Wide Area Networks (WAN), Wireless networks, optical networks, distributed networks, the Internet or any combination thereof are some examples of the type of communication paths that may be utilized by the specially program computer system of the invention. Communication Path 1026 may comprise any type of telecommunication network or interconnection fabric that can transport data to and from Communication Interface 1024.

To facilitate user interaction with the specially programmed computer system of the invention, one or more Human Interface Devices (HID) 1030 may be provided. Some examples of HIDs that enable users to input commands or data to the specially programmed computer of the invention may comprise a keyboard, mouse, touch screen devices, microphones or other audio interface devices, motion sensors or the like, as well as any other device able to accept any kind of human input and in turn communicate that input to Processor 1003 to trigger one or more responses from the specially programmed computer of the invention are within the scope of the system of the invention.

While FIG. 10 depicts a physical device, the scope of the system of the invention may also encompass a virtual device, virtual machine or simulator embodied in one or more computer programs executing on a computer or computer system and acting or providing a computer system environment compatible with the methods and processes of the invention. Where a virtual machine, process, device or otherwise performs substantially similarly to that of a physical computer system of the invention, such a virtual platform will also fall within the scope of a system of the invention, notwithstanding the description herein of a physical system such as that in FIG. 10.

One or more embodiments of the invention are configured to enable the programmed computer of the invention to take the input data given and transform it into an electronic bingo game variation by applying one or more of the methods and/or processes of the invention as described herein. Thus the methods described herein are able to transform button presses, cash card input data, touch screen data, system computations of winning numbers, pattern matches and other data, using the system of the invention to result in an output of the system as an electronic bingo game variation, using the programmed computer as described herein. Particularly, the system of the invention may be programmed to provide an electronic bingo game variation of the invention as described herein.

While the invention herein disclosed has been described by means of specific embodiments and applications thereof, numerous modifications and variations could be made thereto by those skilled in the art without departing from the scope of the invention set forth in the claims. The foregoing description is therefore considered in all respects to be illustrative and not restrictive. The scope of the invention is indicated by the appended claims, and all changes that come within the meaning and range of equivalents thereof are intended to be embraced therein.

What is claimed is:

1. An apparatus comprising a machine-readable medium having computer program code stored thereon which when executed by a machine causes said machine to perform a method of conducting an electronic bingo game variation, said method comprising:

generating a first electronic bingo card for an electronic bingo game, wherein said first electronic bingo card comprises a matrix of squares, each square comprising an assigned character chosen from a predetermined set of available characters;

drawing a bingo ball comprising a character selected from said predetermined set of available characters, and continuing to draw additional bingo balls until a complete drawing pool has been created;

comparing said character of each bingo ball in said complete drawing pool to each said assigned character of said first electronic bingo card to determine a match;

electronically daubing said match on said first electronic bingo card, thereby creating a pattern by said daubing on said first electronic bingo card;

comparing said pattern to a set of qualifying patterns to confirm said pattern is in said set of qualifying patterns, thereby identifying said first electronic bingo card as a qualifying electronic bingo card;

offering a second chance to win for said qualifying electronic bingo card, said second chance to win comprising:

repopulating said each square of said qualifying electronic bingo card, exclusive of said each square of said qualifying pattern, each with a new character selected from said set of available characters to create a second electronic bingo card; and applying said complete drawing pool to said second electronic bingo card to identify said second electronic bingo card as a winner.

2. The apparatus of claim 1 wherein said electronic bingo game is a multi-player game.

3. The apparatus of claim 1 wherein said offering said second chance to win further comprises collecting a second chance fee.

4. The apparatus of claim 3 wherein said second chance fee is the expected value of the second electronic bingo card.

5. The apparatus of claim 1 wherein a player selects said predetermined set of available characters from a plurality of predetermined sets of available characters.

6. The apparatus of claim 1 wherein a player is offered a plurality of said second chance to win opportunities.

7. The apparatus of claim 1 wherein said set of qualifying patterns comprises: bingo, perimeter, double pyramid, letter M, letter W and two lines.

8. The apparatus of claim 1 further comprising said complete drawing pool comprising at most 39 of 75 bingo balls, wherein said applying said complete drawing pool to said second electronic bingo card further comprises comparing said second electronic bingo card to said complete drawing pool.

9. The apparatus of claim 1 wherein said assigned character is chosen from said predetermined set of available characters using a pseudo-random generation algorithm.

10. The apparatus of claim 1 wherein a player selects said assigned character from said predetermined set of available characters.

11. A computer-implemented method performed by at least one computing device, in said at least one computing device comprises a non-transitory storage device, said method comprising:

generating a first electronic bingo card for an electronic bingo game, wherein said first electronic bingo card comprises a matrix of squares, each square comprising an assigned character chosen from a predetermined set of available characters;

drawing a bingo ball comprising a character selected from said predetermined set of available characters, and continuing to draw additional bingo balls until a complete drawing pool has been created;

comparing said character of each bingo ball in said complete drawing pool to each said assigned character of said first electronic bingo card to determine a match;

electronically daubing said match on said first electronic bingo card, thereby creating a pattern by said daubing on said first electronic bingo card;

comparing said pattern to a set of qualifying patterns to confirm said pattern is in said set of qualifying patterns, thereby identifying said first electronic bingo card as a qualifying electronic bingo card;

offering a second chance to win for said qualifying electronic bingo card, said second chance to win comprising:

repopulating said each square of said qualifying electronic bingo card, exclusive of said each square of said qualifying pattern, each with a new character selected from said set of available characters to create a second electronic bingo card; and applying said complete drawing pool to said second electronic bingo card to identify said second electronic bingo card as a winner.

12. The method of claim 11 further comprising the step of accepting a wager from a player.

13. The method of claim 11 wherein a player is offered a plurality of said second chance to win opportunities.

14. The method of claim 11 wherein said electronic bingo game is a multi-player game.

15. The method of claim 11 further comprising said complete drawing pool comprising at most 39 of 75 bingo balls, wherein said applying said drawing pool to said second electronic bingo card further comprises comparing said second electronic bingo card to said complete drawing pool.

16. A computer program product for electronic bingo, said computer program product comprising computer-readable program code, said computer-readable program code executing in a tangible memory medium and configured to perform an electronic bingo game method comprising:

generating a first electronic bingo card for an electronic bingo game, wherein said first electronic bingo card comprises a matrix of squares, each square comprising an assigned character chosen from a predetermined set of available characters;

drawing a bingo ball comprising a character selected from said predetermined set of available characters, and continuing to draw additional bingo balls until a complete drawing pool has been created;

comparing said character of each bingo ball in said complete drawing pool to each said assigned character of said first electronic bingo card to determine a match;

electronically daubing said match on said first electronic bingo card, thereby creating a pattern by said daubing on said first electronic bingo card;

comparing said pattern to a set of qualifying patterns to confirm said pattern is in said set of qualifying patterns, thereby identifying said first electronic bingo card as a qualifying electronic bingo card;

offering a second chance to win for said qualifying electronic bingo card, said second chance to win comprising:

repopulating said each square of said qualifying electronic bingo card, exclusive of said each square of said qualifying pattern, each with a Original character selected from said set of available characters to create a second electronic bingo card; and applying said complete drawing pool to said second electronic bingo card to identify said second electronic bingo card as a winner.

17. The computer program product of claim 16 wherein a player pays a fee for said first electronic bingo card.

18. The computer program product of claim 16 wherein the step of electronically daubing said match on said first electronic bingo card, thereby creating a pattern by said daubing on said first electronic bingo card is completed upon receiving instructions from a player.

19. The computer program product of claim 16 wherein said complete drawing pool comprises at most 39 of 75 bingo balls, wherein said applying said complete drawing pool to said second electronic bingo card complete drawing pool.

20. The computer program product of claim 16 wherein said applying said drawing pool to said second electronic bingo card further comprises comparing said second electronic bingo card to said drawing pool.

* * * * *